US005122158A

United States Patent [19]

Kuroda et al.

[11] Patent Number: 5,122,158

[45] Date of Patent: Jun. 16, 1992

[54] PROCESS FOR CLEANING CLOTHES

[75] Inventors: Muthumi Kuroda; Akira Suzuki, both of Funabashi; Kazuo Iguchi, Nagareyama; Yumio Nakasone, Saitama, all of Japan

[73] Assignee: Kao Corporation, Tokyo, Japan

[21] Appl. No.: 294,982

[22] Filed: Jan. 6, 1989

Related U.S. Application Data

[63] Continuation of Ser. No. 177,907, Apr. 4, 1988, abandoned, which is a continuation of Ser. No. 774,877, Sep. 12, 1985, abandoned, which is a continuation of Ser. No. 395,919, Jul. 7, 1982, abandoned.

[30] Foreign Application Priority Data

Jul. 16, 1981 [JP] Japan ..... 56-111753

[51] Int. Cl.[5] ..... D06F 15/00; C11D 17/00

[52] U.S. Cl. ..... 8/137; 252/90; 252/114; 252/174.12; 252/DIG. 19; 15/104.93; 15/104.94; 401/202

[58] Field of Search ..... 8/137; 252/90, 174, 252/174.12, DIG. 19; 15/104.93, 104.94; 401/202

[56] References Cited

U.S. PATENT DOCUMENTS

| | | | |
|---|---|---|---|
| 2,896,236 | 7/1959 | Bartkewitz | 401/202 |
| 3,046,593 | 7/1962 | Goldman et al. | 401/202 |
| 3,741,902 | 6/1973 | Barrett | 252/90 |
| 3,748,268 | 7/1973 | Loudas | 252/90 |
| 3,953,353 | 4/1976 | Barrett et al. | 252/90 |
| 4,053,243 | 10/1977 | Levin | 401/202 |
| 4,111,567 | 9/1978 | Berghahn | 401/202 |

FOREIGN PATENT DOCUMENTS

| | | | |
|---|---|---|---|
| 109664 | 5/1984 | European Pat. Off. | 15/106 |
| 0069981 | 5/1979 | Japan . | |

*Primary Examiner*—Prince E. Willis
*Assistant Examiner*—John F. McNally
*Attorney, Agent, or Firm*—Birch, Stewart, Kolasch & Birch

[57] ABSTRACT

A method and device for speeding-up and enhancing the cleaning of soiled parts of clothes by rub-coating with an enzyme-containing liquid detergent by means of a porous body made of heated and sintered synthetic plastic material.

13 Claims, 1 Drawing Sheet

PROCESS FOR CLEANING CLOTHES

This application is a continuation of application Ser. No. 07/177,907 filed on Apr. 4, 1988, now abandoned, which is a continuation of application Ser. No. 774,877 filed on Sep. 12, 1985, now abandoned, which is a continuation of application Ser. No. 06/395,919 filed on Jul. 7, 1982, now abandoned.

BACKGROUND OF THE INVENTION

This invention relates to a process for cleaning clothes using an enzyme-containing liquid detergent and a special container therefor. More particularly it relates to a process for cleaning clothes which comprises a step of applying the enzyme-containing liquid detergent to soiled necks and wristbands as well as various spots by means of a specific coating-type container to remove the stains and finish the clothes very cleanly.

It is well known that especially persistent stains in worn clothes are those soaking into the necks and wristbands thereof. Further stains such as spots due to spilt foods and proteinic blots on baby clothes are very unremovable. Previously known methods for removing these stains, include smearing a solid soap thereon followed by crumpling the clothes; transferring a liquid detergent from a container to a cap thereof and coating them with a cap of the detergent; and spraying a liquid detergent thereonto. These methods show a certain effect compared with a usual washing method and are often practiced in the home. However they are still insufficient to remove the stains completely.

In order to enhance the removing of proteinic stains, it is known to add a proteolytic enzyme protease to a powder detergent. An enzyme has a temperature suitable for the enzymatic action thereof (the temperature being hereinafter referred to as "optimal temperature") and shows a maximum effect at the optimal temperature, which is usually from 40° to 60° C.

SUMMARY OF THE INVENTION

An object of the invention is to provide a process for cleaning clothes which is especially effective for removing persistent stains soaking into the necks and wristbands thereof as well as spots due to spilt foods and proteinic blots thereon.

Another object of this invention is to provide an enzyme-containing liquid detergent and a special container for containing said detergent therein which are used in the above process.

Other and further objects, features and advantages of the invention will appear more fully from the following description.

We have made various studies on whether an effect of removing stains on the necks and wristbands, spot stains, etc. can be improved remarkably by utilizing the temperature dependence of the enzymatic action. As a result we have unexpectedly found that by rub-coating soiled clothes with an enzyme-containing liquid detergent by means of a special coating-type container therefor, a surface temperature of the clothes increases due to a heat of friction and a enzymatic reaction proceeds rapidly so that the soiled clothes can be finished very cleanly.

A process for cleaning clothes according to the present invention comprises a step of rub-coating soiled parts of the clothes with an enzyme-containing liquid detergent by means of a coating type liquid container, a coating portion of which is composed of a porous body made of synthetic plastics material.

BRIEF EXPLANATION OF THE DRAWINGS

FIG. 1 shows a longitudinally sectional view of a coating portion having a convex shaped coating face used in the present invention.

FIG. 2 shows a longitudinally sectional view of another coating portion having a planar shaped coating face used in the present invention.

FIG. 3 shows a longitudinally sectional view of a conventional sponge type coating portion.

FIG. 4 shows a longitudinally sectional view of a conventional roll-on type coating portion.

DETAILED DESCRIPTION OF THE PREFERRED EMBODIMENTS

Figure 1:
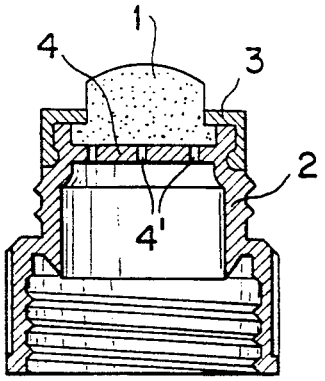
FIGS. 1–4 show the outline of essential parts of various coating type liquid containers.

According to the present invention, a heat of friction is produced in the above-mentioned rub-coating step to increase the surface temperature of the clothes, whereby the enzymatic reaction can proceed rapidly so that the stains on the clothes can be removed very cleanly. Subsequent to the rub-coating step, the entire clothes articles are conventionally washed by means of a washing machine or the like.

In order to produce a heat of friction during the rub-coating step in the present invention, it is preferable to scrub the clothes with a coating portion of a container and to repeatedly apply an enzyme-containing detergent contained in the container onto the clothes. We have measured the increase in temperature due to the heat of friction by means of a thermotape which was laid under the clothes. As a result we have observed that the temperature increased easily by two or three degrees centigrade by using a coating type liquid container having a coating portion of which is composed of a porous body made of synthetic plastics material and found that it is also possible to increase the temperature by about 10° C. The rub-coating is a preferable washing method because of the production of heat by friction as well as the penetration of the liquid detergent into the fibrous structure of the clothes. Since the temperature dependence of the enzymatic action is great, even a slight increase in temperature can bring about favorable results.

The porous body made of synthetic plastics material used as the coating portion of the container in the present invention is usually produced by heating and sintering granules of synthetic plastics material having a fixed particle size in a mold. The porous body thus obtained is an open cell foam having suitable firmness and strength. Therefore when it is used as a coating portion of the container, it is possible to rub the clothes to such an extent that they are not damaged, while at the same time speeding the reaction of the enzyme contained in the liquid detergent. Further, since the pore size and distribution of open cells are highly uniform, the liquid detergent can be favorably passed therethrough and a wide and uniform coating locus can be stably obtained.

It is a matter of course that a roll-on type container which is known as a liquid coating container cannot produce friction because of its structure. Another known coating container has a coating portion composed of a sponge or plastic foam which is different from an open cell foam having suitable firmness and strength, and, therefore, it cannot exhibit a temperature increasing effect.

In the practice of the present invention, the enzyme-containing liquid detergent is rub-coated preferably at a rate of 20–50 cm/sec under a load of preferably 0.2–10 kg/cm$^2$, more preferably 0.5–3 kg/cm$^3$. An amount of the enzyme-containing liquid detergent applied is preferably 0.1–5 g/100 cm$^2$, more preferably 0.2–2 g/100 cm$^2$. As the preferably porous body, there are used those having such a structure that makes it possible to apply the above-mentioned amount of the liquid detergent when the present invention is practiced under the above-mentioned conditions. Those having a means pore size of 50 to 1,000 microns, preferably 300 to 700 microns are used. Further the porous body is preferably to have a flow rate of the enzyme-containing liquid detergent of 5 to 30 g/min. The flow rate means an amount per unit time (minute) of the enzyme-containing liquid detergent flowing out through the coating portion of the liquid container when the liquid container, the bottom of which has been cut off, is placed so that the coating portion thereof composed of the porous body points downward and then it is filled with the liquid detergent in an amount corresponding to 12 cm of liquid level per cm$^2$ of the surface area of the porous body (the cross-sectional area in case that the porous body is convex shaped) at 20° C.

When the above-mentioned flow rate is too much or too little, a wide and uniform coating locus cannot be stably obtained. In case of a flow rate which is too little, the function of the coating type container cannot be fully exhibited. On the other hand, it is self-evident that too much flow rate is unpreferable in view of the friction effect and is also uneconomical.

As the raw synthetic plastics materials for the porous body, there can be used various high molecular materials, among which polypropylene, polyethylene, ethylene-vinyl acetate copolymer, acrylonitrile-styrene copolymer and acrylonitrile-butadiene-styrene copolymer are preferable because they can provide porous bodies which are not damaging to the clothes and have suitable firmness and strength for enhancing the friction effect.

According to the present invention, it is desirable that the diameter of the coating portion in the coating type container be 1 cm or more in order to enhance the friction effect. Further, it is desirable that a container part of the coating-type container be such that it can be taken in the hand. Furthermore, with respect to the shape of the coating portion, a convex shape is more preferable than a planar shape because of good workability and enhanced friction effect.

Figure 2:
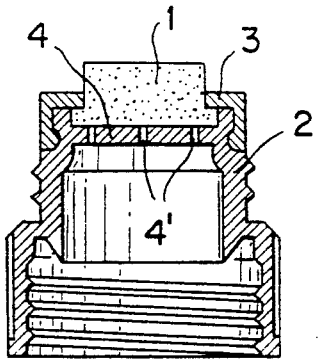
Figure 3:
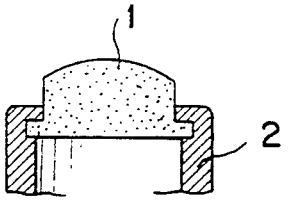
Figure 4:
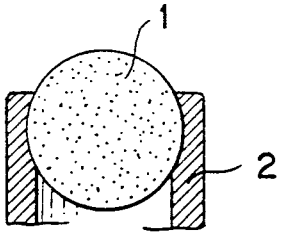
Figure 5:
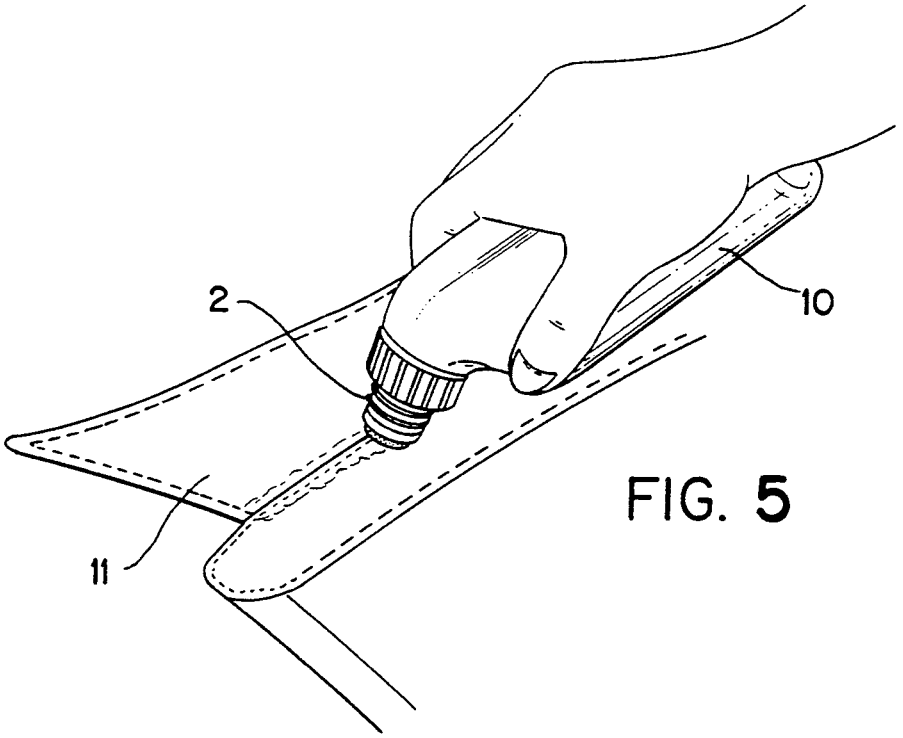
FIG. 5 shows the outline of an embodiment of this invention.

As shown in FIGS. 1–4, the coating type container used in the present invention is composed of a cap part 2 having a coating portion 1 of said porous body, and a container part 10 (shown in FIG. 2) in which the enzyme-containing liquid detergent is filled connected with a screw. More particularly the coating portion 1 is fixed by a holding means 3 at the top of the cap part 2 and the back side thereof is supported with a supporting plate 4 having a plurality of holes 4'. As shown in FIG. 2, keeping the coating face of the coating means 1 in touch with a soiled part of clothes 11, one rub-coats the soiled part with the enzyme-containing liquid detergent in the container part 10.

As the enzyme-containing liquid detergent used in the present invention there can be listed an enzyme-containing liquid detergent composition containing the following components.

(1) Anionic surfactant: 10–40%
(2) Nonionic surfactant: 10–40%
(3) Enzyme: 0.05–10%
(4) Solubilizing agent: 1–10%

In order to perform the above-mentioned rub-coating more effectively to further increase the cleaning effect of the clothes, the viscosity of the enzyme-containing liquid detergent should be considered. In addition to the viscosity, various factors such as washing power and safety should be considered. With regard to these factors, it is preferable to use as the enzyme-containing liquid detergent those having a viscosity of 50–500 cp.

As the anionic surfactant (1), the followings are especially preferable.

Polyoxyethylene alkyl ether sulfate which has a linear or branched alkyl group having an average carbon number of 10–16 and in which an average mole number of ethylene oxide added in a molecular is 3–6 when the alkyl group is linear and 2–4 when it is branched.

As the anionic surfactant, there can also be used at least one of the anionic surfactants selected from (1)–(9) mentioned below together with, or instead of, the above-mentioned anionic surfactant. Among them, the particularly preferred are those shown in (1), (2), (3), (4) and (5).

(1) Linear or branched alkylbenzenesulfonates with an alkyl group having an average carbon number of 10–20.

(2) Alkyl or alkenyl ether sulfates which has a linear or branched alkyl group having an average carbon number of 10–20 and in which, on the average, 0.5 to 8 moles of either ethylene oxide (EO), or propylene oxide (PO) or butylene oxide (BO) is added in a molecule; or, on the average. 0.5 to 8 moles of EO and PO are added in a molecule in a proportion of EO/PO of 0.1/9 to 9.9/0.1; or, on the average, 0.5–8 moles of EO and BO are added in a molecule in a proportion of EO/BO of 0.1/9.9–9.9/0.1.

(3) Alkyl or alkenyl sulfates having an alkyl or alkenyl group of which an average carbon number is 10–20.

(4) Olefine sulfonates having an average number of carbon atoms of 10–20 in a molecule.

(5) Alkane sulfonates having an average number of carbon atoms of 10–20 in a molecule.

(6) Saturated or unsaturated fatty acid salts having a average carbon atoms of 10–24 in a molecule.

(7) Alkyl or alkenylether carboxylic acid salts which have an alkyl or alkenyl group atoms of 10 to 20 and in which, on the average, 0.5 to 8 moles of either ethylene oxide (EO), propylene oxide (PO) or butylene oxide (BO) is added in a molecule; or, on the average, 0.5 to 8 moles of EO and PO are added in a molecule in a proportion of EO/PO of 0.1/9.9 to 9.9/0.1; or, on the average 0.5 to 8 moles of EO and BO are added in a molecule in a proportion of EO/BO of 0.1/9.9 to 9.9/0.1.

(8) α-sulfofatty acid sales or esters represented by the following formula:

$$R-\underset{\underset{SO_3Z}{|}}{CH}CO_2Y$$

(wherein Y is an alkyl group of 1 to 3 carbon atoms or a paired ion, Z is a paired ion, and R is an alkyl or alkenyl group of 10 to 20 carbon atoms.)

As the paired ions in the anionic surfactant, there can be referred to alkali metal ions such as sodium and potassium ions; alkaline earth metal ions such as calcium and magnesium ions; ammonium ion; and alkanolamines having 1 to 3 alkanol groups of 2 or 3 carbon atoms, e.g. monoethanolamine, diethanolamine, triethanolamine and triisopanolamine or the like.

(9) Amino acid type surfactants represented by the following general formulae:

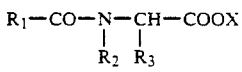

No. 1

(wherein $R_1$ is an alkyl or alkenyl group of 8–24 carbon atoms, $R_2$ is hydrogen or an alkyl group of 1 or 2 carbon atoms, $R_3$ is a residual group of the amino acid, and X is alkali metal or alkaline earth metal ion.)

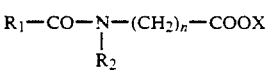

No. 2

(wherein $R_1$, $R_2$ and X are the same as those mentioned above and n is an integer of 1 to 5.)

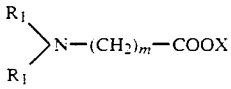

No. 3

(wherein $R_1$ is the same as mentioned above and m is an integer of 1 to 8.)

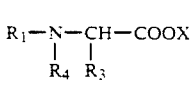

No. 4

(wherein $R_1$, $R_2$ and X are the same as mentioned above and $R_4$ is hydrogen or an alkyl or hydroxyalkyl group of 1 or 2 carbon atoms.)

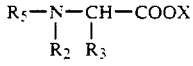

No. 5

(wherein $R_2$, $R_3$ and X are the same as mentioned above and $R_5$ is $\beta$-hydroxyalkyl or $\beta$-hydroxyalkenyl of 6 to 28 carbon atoms.)

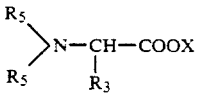

No. 6

(wherein $R_3$, $R_5$ and X are the same as mentioned above.)

As the nonionic surfactant 2 , the followings are particularly preferable.

(a) Polyoxyethylene sec-alkyl ether which has an alkyl group having an average carbon number of 10–14 and in which an average mole number of ethylene oxide added in a molecule is 5–12.

(b) Polyoxypropylene polyoxyethylene linear alkyl ether which has an alkyl group having an average carbon number of 8 or 10 and in which an average mole number of propylene oxide added in a molecule is 1–5, preferably 1–3 and an average mole number of ethylene oxide added in a molecule is 1–20, preferably 5–10.

As the nonionic surfactant (2), there can also be used at least one of those selected from (10)–(17) mentioned below together with, or instead of, the above-mentioned surfactants (a) and (b). Among them, particularly preferred are those shown in (10), (11) and (14).

(10) Polyoxyethylene alkyl or alkenyl ethers which have an alkyl or alkenyl group with an average number of carbon atoms of 10 to 20 and in which 1 to 20 moles of ethylene oxide is added.

(11) Polyoxyethylene alkyl phenyl ethers which have an alkyl group with an average number of carbon atoms of 6 to 12 and in which 1 to 20 moles of ethylene oxide is added.

(12) Polyoxypropylene alkyl or alkenyl ethers which have an alkyl or alkenyl group with an average number of carbon atoms of 10 to 20 and in which 1 to 20 moles of propylene oxide is added.

(13) Polyoxybutylene alkyl or alkenyl ethers which have an alkyl or alkenyl group with an average number of carbon atoms of 10 to 20 and in which 1 to 20 moles of butylene oxide is added.

(14) Nonionic surfactants which have an alkyl or alkenyl group with an average number of carbon atoms of 10 to 20 and in which totally 1 to 30 moles of ethylene oxide (EO) and propylene oxide (PO) or EO and butylene oxide (BO) are added in a proportion of EO/PO or EO/BO or 0.1/9.9 to 9.9/0.1.

(15) Higher fatty acid alkanol amides or their alkylene oxide adducts represented by the following general formula:

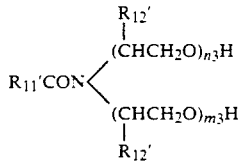

(wherein $R'_{11}$ is an alkyl or alkenyl group of carbon atoms of 10 to 20, $R'_{12}$ is hydrogen or methyl, $n_3$ is an integer of 1 to 3 and $m_3$ is an integer of 0 to 3.)

(16) Sucrose fatty acid esters obtained from a fatty acid with an average number of carbon atoms of 10 to 20 and sucrose.

(17) Fatty acid glycerol monoesters obtained from a fatty acid with an average number of carbon atoms of 10 to 20 and glycerol.

As the enzyme (3), it is preferable to use at least one hydrolases such as protease, lipase, amylase and cellulase, the origins of which are listed below. Further, the amount of the enzyme (3) in the liquid detergent is preferably 0.05 to 10% by weight. As a preferable enzyme, there can be used to protease decomposing proteinic soils and cellulose swelling the fiber to make the soils easily removable.

As the enzyme (3) which is an essential component in the present invention, there can be non-restrictively used those which are widely distributed in animals and plants, bacteria and fungi as well as their purified fractions.

As the origins of cellulase, the followings are exemplified.

(a) Protozoa (Ciliata, Flagellata, Amoeba, etc.)

(b) Mollusc (Snail, Soft clam, Shipworm, etc.)

(c) Nematoda (d) Annelida
(e) Echinodermata (Sea chestnut, etc.)
(f) Crustacea
(g) Insecta (Ant, Beetle, etc.)
(h) Bacteria (Cellulomonas sp., Bacillus sp.)
(i) Fungi; Hyphomycetes (*Fungi imperfecti,* Phycomycetes, Asomycetes, etc.)
(*Aspergillus niger, Asperigillus oryzae,* Takamine-cellulase, *Humicola insolens,* Rhizopus sp., *Aspergillus cellulosae,* Aspergillus sp.)
(j) Algae
(k) Lichenes
(l) Land green plants In addition, the following alkali cellulases can be used.

(m) Cellulase obtained by culturing microorganisms belonging to Genus Bacillus of which the microorganism deposit numbers in Bikoken (the Fermentation Research Institute in Japan) are 1138, 1139, 1140 and 1141, respectively (See Japanese Patent Publication No. 28515/1975).
(n) Cellulase produced from Cellulase 212 - producing microorganism belonging to Genus Aeromonas of which the microorganism deposit number in Bikoken is 2306.

The following commercially available cellulases originated from the above-mentioned origins can be used in the present invention.

(1) Celluase AP from Amano Pharmaceutical) K.K.
(2) Cellulosin AP from Ueda Chemical K.K.
(3) Cellulosin AC from Ueda Chemical K.K.
(4) Cellulase-Onozuka from Kinki Yakult K.K.
(5) Pancellase from Kinki Yakult K.K.
(6) Macerozyme from Kinki Yakult K.K.
(7) Meicelase from Meiji Confectionery K.K.
(8) Celluzyme from Nagase K.K.
(9) Soluble Sclase from Sankyo Pharmaceutical K.K.
(10) Sanzyme from Sankyo Pharmaceutical K.K.
(11) Cellulase A-12-C from Takeda Pharmaceutical Ind. K.K.
(12) Toyo-Cellulase from Toyo Brewing K.K.
(13) Driserase from Kyowa Fermentation Industries K.K.
(14) Luizyme from Luipald Werk Co.
(15) Takamine-Cellulase from Chemische Fabrik Co.
(16) Wallerstein-Cellulase from Sigma Chemicals Co.
(17) Cellulase Type I from Sigma Chemicals Co.
(18) Cellulase Serva from Serva Laboratory Co.
(19) Cellulase 36 from Rohm & Haas Co.
(20) Miles Cellulase 4,000 from Miles Co.
(21) R & H Cellulase 35, 36, 38 Conc. from Philip Morris Co.
(22) Combizym from Nysco Laboratory Co.
(23) Cellulase from Makor Chemicals Co.
(24) Cellucrust from Novo Industry Co.
(25) Cellulase from Gist-Brocades Co.

As the cellulase there are preferably used, those having their enzymatic activity of at least 0.001 unit/mg of solid content (1 unit/mg of solid content means an enzymatic activity of cellulase when it produces 1.0 $\mu$ mole of glucose from cellulose at a temperature of 37° C. and pH of 5 for 1 hour) one most preferred. The amount of cellulase in the liquid detergent composition is preferably from 0.01 to 10% by weight, more preferably from 0.1 to 10% by weight.

As preferable hydrolases other than cellulase, there can be lifted carboxylic acid hydrase acting on an ester linkage, thiol ester hydrase, glycoside hydrase and peptidyl peptide hydrase, examples of which are given as under.

(1) Protease belonging to peptidyl peptide hydrase
Subtilisin, Collagenase, Keratinase
(2) Glycoside hydrase
Cellulases which have been mentioned above are excluded from the group of glycoside hydrase.
Preferred are $\alpha$-amylase, pectinase, chitinase.
(3) Carboxylic acid ester hydrase
Lipase Commercially available enzyme products and their manufacturers are listed below.

Alkalase, Esperase, Sabinase, AMG, BAN, Fungamil, Sweetzyme and Termamil from Novo Industry Co., Copenhagen, Denmark.
Macsatase-P, High Alkaline Protease, Amylase THC and Lipase from Delft Gist Prokeides n.v., Netherland
Protease B-400, Protease B-4000, Protease AP and Protease AP 2100 from Schweitzlische Ferment A.G., Basel, Switzerland
CRD-Protease from Monsanto Co., St. Louis, Mo., U.S.A.
Piokase from Piopin Corp., Monticers, Ill., U.S.A.
Pronase-AS and Pronase-AF from Kaken Chemical K.K., Japan
Lapidase P-2000 from Lapidas, Sekran, France
Proteolytic enzyme products (a particle size of 100% passing through a Tyler standard sieve of 16 mesh and 100% remaining on a Tyler standard sieve of 150 mesh) from Chrinton Corn Products Co. (a division of Standard Brands Co., New York)
Takamine, Bromelein 1:10, HT Proteolytic Enzyme 200 and Enzyme L-W (obtained from not bacteria but mould) from Miles Chemical Co., Elkheart, Ind., U.S.A.
Lozyme P-11 Concentrate, Pectinol, Lipase B, Lozyme PF and Lozyme J-25 from Rhom & Haas Co., Philadelphia, U.S.A.
Amprozyme 200 from Jack Wolf & Co., a subsidiary of Novco Chemical Co., New Jersey, U.S.A.
ATP 40, ATP 120 and ATP 160 from Lapidas, Sekran, France
Olivase from Nagase Industries, Japan The amount of the above hydrases other than cellulase incorporated into the detergent composition can be determined depending on each purpose, but is preferred to be 0.001–5% by weight, especially 0.02–3% by weight if converted into the weight of purified enzyme.

As the solubilizing agents (4), the following can be used.

Lower alcohols, lower alkylbenzensulfonates, glycols. In addition, the following auxiliary components may be used.

(1) Betain type ampholytic or cationic surfactants
(2) Divalent metal ion scavengers At least one of builder components selected from the undermentioned salts (alkali metal salts or alkanol amine salts) and polymers may be contained in an amount of less than 50% by weight.

Phosphates, Phosphonates, Phosphonocarboxylates, Salts of amino acids, aminopolyacetates, Polyelectrolytes, Non-dissociative polymers, Salts of organic acids, (3) Alkaline agents
(4) Resoiling preventing agents
(5) Laundry bluing agents and fluorescent dyes The present invention is further explained concretely referring to Examples.

EXAMPLE 1

The coating type containers used in the present invention are compared with various conventional coating type containers with respect to coating state, coating workability, effect of producing a heat of friction by coating, and degree of cleaning soiled natural cloths.

(1) Liquid detergent composition used

| | |
|---|---|
| Sodium sulfate of alkyl ($\overline{C}$ = 14.3) polyoxyethylene ($\overline{P}$ = 2.5) | 20% |
| Polyoxypropylene ($\overline{P}$ = 3) polyoxyethylene (P = 8) linear decyl ether | 30% |
| Triethanolamine | 3% |
| Fluorescent dye | 0.3% |
| Ethanol | 5% |
| Water | balance |
| Proteolytic enzyme (Espelase liquid 8.0 L from Novo Industry Co.) | 0.3% |

(2) Coating portion of the containers (See FIG. 1.)

(a) Convex shaped porous body used in the present invention.

(b) Planar type porous body used in the present invention.

(c) Sponge used for comparison (d) Roll-on type used for comparison.

(3) Evaluation of coating state and coating workability

The coating type containers mentioned in (2) were each filled with the liquid detergent mentioned in (1), which was then applied to a soiled part of half-cut natural cloth at an coating rate of about 30 cm/sec under a load of 2 kg/cm$^2$. A coating amount was 3 ml per sheet of soiled cloth and totally 21 ml with respect to one washing system (set) consisting of seven sheets of cloth.

The coating state, i.e. the uniformity of the coating was evaluated based on the following criteria.

○ . . . Uniformly applicable at a constant amount

Δ . . . Partly unevenly applied

× . . . Unevenly applied

Apart from the coating state, the coating workability, i.e. the easiness of coatings, was evaluated based on the following criteria.

○ . . . The liquid detergent flows out smoothly and is easily applicable.

× . . . The coating cannot be performed smoothly.

Δ . . . Intermediate between ○ and ×

(4) Effect of producing a heat of friction by coating

The heat of friction produced during coating was measured at a room temperature of 26° C. using a thermistor (YEW TYPE 2809 digital thermometer) placed under a soiled cloth.

(5) Preparation of soiled cloth

A mixed cloth of cotton and tetrone (9 cm×30 cm) was sewed on a collar of utility shirt, which was then worn by an adult man for two days. After having been worn, cloths in which soiling is symmetrical with respect to a central point thereof were selected and half-cut at a point of symmetry to submit them for examination.

(6) Washing conditions

| | |
|---|---|
| Washing operation | Use of a utility washing machine (Palseta type) |
| Water used | 30 l of city water |
| Water temperature | 20° C. |
| Washing time | 10 minutes |
| Rinse | Overflowing rinse of city water for 5 minutes |

(7) Evaluation of degree of cleaning

As mentioned in (5), a sheet of soiled cloth was half-cut so that soiling was divided symmetrically. One of the half-cut cloths obtained above was washed after merely dropping the liquid detergent thereon without using the coating type container. The other half-cut cloth was washed after rub-coating the liquid detergent thereon by means of coating type container having coating portion (a), (b), (c) or (d).

The degree of soiling of washed half-cut cloths was determined by a pair comparison with the naked eye. In the determination, as a reference, the standard soilings graded at 10 levels according to the degree of soiling was used.

The degree of cleaning in case of using the coating type container was indicated by scores in comparison with the standard score (100) indicating the degree of cleaning obtained without using the coating type container.

TABLE 1

| Coating type container | Coating state of liquid detergent | Coating workabitily | Temperature at coating | Degree of cleaning of soiled cloths |
|---|---|---|---|---|
| — | — | — | — | 100 |
| Coating portion (a) | ○ | ○ | 36° C. | 106 |
| Coating portion (b) | ○ | Δ–x | 36° C. | 105 |
| Coating portion (c) | x | Δ | 28° C. | 102 |
| Coating portion (d) | x | ○ | 26° C. | 101 |

Note (1):
The value of degree of cleaning is the average value of seven sheets of cloth.
The higher value means the higher cleaning effect.

The above-mentioned results clearly show that the cleaning effect of the enzyme-containing liquid detergent is optimally brought out by using the coating type containers having coating portion (a) and (b), the coating portion of which is composed of the porous body, especially the coating portion (a), the coating portion of which is convex shaped.

EXAMPLE 2

The enzyme-containing liquid detergent was applied on soiled part of cloth by means of the coating type containers and the cleaning effect was measured.

(1) The liquid detergent A used as control has the following composition.

| | |
|---|---|
| Sodium sulfate of alkyl ($\overline{C}$ = 14.3) polyoxyethylene ($\overline{P}$ = 2.5) | 20% |
| Polyoxypropylene ($\overline{P}$ = 3) polyoxyethylene ($\overline{P}$ = 8) linear decyl ether | 30% |
| Triethanolamine | 3% |
| Fluorescent dye | 0.3% |
| Ethanol | 5% |
| Water | balance |

The liquid detergent B used in this example is the same as that used in Example 1.

(2) Washing method

| | | |
|---|---|---|
| Method 1 | Liquid detergent A | Non-use of coating type container |
| Method 2 | Enzyme-containing liquid detergent B | Non-use of coating type container |
| Method 3 | Liquid detergent A | Use of container having coating portion (a) used in Example 1 |
| Method 4 (Present Invention) | Enzyme-containing liquid detergent B | Use of container having coating portion (a) used in Example 1 |

Soiled cloths are prepared in the same manner as in Example 1. In addition, other conditions of coating and washing as well as a method for measuring the temperature at coating are the same as those in Example 1.

(3) Evaluation of degree of cleaning

Table 2 shows a temperature at coating and a degree of cleaning of soiled natural cloths observed when carrying out each washing method.

TABLE 2

| Washing method | Enzyme in detergent composition | Coating type Container | Temperature at coating | Degree of cleaning of soiled natural cloth |
|---|---|---|---|---|
| 1 | No | Non-use | 28° C. | 100 (standard) |
| 2 | Yes | " | 28° C. | 103 |
| 3 | No | Use | 36° C. | 102 |
| 4 (Present Invention) | Yes | " | 36° C. | 106 |

As is clear from Table 2, especially remarkable improvements in enzymatic action and cleaning effect are observed in the washing method 4 where both the enzyme-containing liquid type container are used.

As mentioned above, according to the present invention, a sufficient heat of friction can be produced in the rub-coating step wherein the soiled parts of clothes are rub-coated with the enzyme-containing liquid detergent by means of the coating type liquid container, the coating portion of which is composed of the porous body made of synthetic plastics material. The heat of friction produced makes it possible to speed up the enzymatic reaction thereby cleaning clothes simply and effectively.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for cleaning clothes which comprises rub-coating soiled parts of clothes to effect a temperature increase at said soiled parts to enhance the cleaning action of an enzyme-containing liquid detergent, said rub-coating being effected by means of a coating type liquid container containing said detergent and including a coating portion comprised of a porous body made of synthetic plastic material having sufficient firmness and strength characteristics to effect a temperature increase upon rub-coating the soiled parts of said clothes and wherein said porous body has a mean pore size of 300 to 700 microns.

2. A process for cleaning clothes according to claim 1, wherein said enzyme-containing liquid detergent is comprised of an enzyme-containing liquid detergent composition containing 10–40% of anionic surfactant, 10–40% of nonionic surfactant, 0.05–10% of enzyme and 1–10% of solubilizing agent.

3. A process for cleaning clothes according to claim 1 or 2, wherein the enzyme contained in said liquid detergent is, at least one of the enzymes selected from the group consisting of protease, lipase, amylase and cellulase.

4. A process for cleaning clothes according to claim 1, wherein the rub-coating of the clothes with said enzyme-containing liquid detergent is carried out at a rate of 20–50 cm/sec under a load of 0.2–10 kg/cm$^2$, and the amount of the detergent applied on the clothes being 0.1–5 g/100 cm$^2$.

5. A process for cleaning clothes according to claim 1, wherein the coating face of said porous body is convex shaped.

6. A process for cleaning clothes according to claim 1, wherein the raw synthetic plastics material for said porous body is selected from the group consisting of polypropylene, polyethylene, ethylene-vinylacetate copolymer, acrylonitrile-styrene copolymer and acrylonitrile-butadiene-styrene copolymer.

7. A process for cleaning clothes according to claim 1, wherein said enzyme-containing liquid detergent has a viscosity of 50–500 cp.

8. A process for cleaning clothes according to claim 1, wherein said rub-coating causes a temperature increase of up to about 10° C.

9. A process for cleaning clothes according to claim 8, wherein said rub-coating causes a temperature increase of from 2° to 3° C. on said soiled parts.

10. A process for cleaning clothes which comprises rub-coating soiled parts of clothes to effect a temperature increase at said soiled parts of from 2° to 20° C. to enhance the cleaning action of an enzyme-containing liquid detergent, said rub-coating being effected by means of a coating-type liquid container containing said detergent and including a coating portion comprised of a porous body having a mean pore size of 300 to 700 microns to permit said detergent to flow out through said coating portion, said porous body being made of synthetic plastic material having sufficient firmness and strength characteristics to effect a temperature increase upon rub-coating the soiled parts of said clothes, and said porous body being one which is prepared by heating and sintering a synthetic plastic material selected from the group consisting of polypropylene, polyethylene, ethylene-vinylacetate copolymer, acrylonitrile-styrene copolymer and acrylonitrile-butadiene-styrene copolymer.

11. A process for cleaning clothes according to claim 10, wherein the coating face of said porous body is convex shaped.

12. A process for cleaning clothes according to claim 10, wherein said rub-coating causes a temperature increase of from 2° to 3° C. on said soiled parts.

13. A process for cleaning clothes according to claim 1, wherein said porous body is one prepared by heating and sintering a synthetic plastic material.

* * * * *